US006913250B2

(12) United States Patent
Osburg et al.

(10) Patent No.: US 6,913,250 B2
(45) Date of Patent: Jul. 5, 2005

(54) CARBURETOR ARRANGEMENT

(75) Inventors: Gerhard Osburg, Kernen (DE); Jochen Gantert, Urbach (DE); Reinhard Gerhardy, Korb (DE)

(73) Assignee: Andreas Stihl AG & Co. KG (DE)

( * ) Notice: Subject to any disclaimer, the term of this patent is extended or adjusted under 35 U.S.C. 154(b) by 109 days.

(21) Appl. No.: 10/625,373

(22) Filed: Jul. 23, 2003

(65) Prior Publication Data

US 2004/0070088 A1 Apr. 15, 2004

(30) Foreign Application Priority Data

Jul. 23, 2002 (DE) ..... 102 33 282

(51) Int. Cl.[7] ..... F02M 17/04

(52) U.S. Cl. ..... 261/35; 261/52; 261/69.1; 261/72.1; 261/DIG. 68

(58) Field of Search ..... 261/35, 52, 69.1, 261/69.2, 72.1, DIG. 8, DIG. 68; 123/179.11

(56) References Cited

U.S. PATENT DOCUMENTS

| | | | | | |
|---|---|---|---|---|---|
| 2,998,232 | A | * | 8/1961 | Mennesson | 261/36.2 |
| 3,743,254 | A | * | 7/1973 | Tuckey | 261/34.2 |
| 3,843,755 | A | * | 10/1974 | Tuckey | 261/69.2 |
| 4,824,613 | A | * | 4/1989 | Scott et al. | 261/35 |
| 4,936,267 | A | * | 6/1990 | Gerhardy et al. | 123/179.16 |
| 5,241,931 | A | * | 9/1993 | Radel | 123/179.14 |
| 5,283,013 | A | * | 2/1994 | Gerhardy | 261/35 |
| 5,341,776 | A | * | 8/1994 | Phelps | 123/73 C |
| 5,743,240 | A | * | 4/1998 | Zerrer et al. | 123/518 |
| 5,891,369 | A | * | 4/1999 | Tuggle et al. | 261/35 |
| 6,079,697 | A | * | 6/2000 | Tuggle et al. | 261/35 |
| 6,354,571 | B1 | * | 3/2002 | Gerhardy | 261/35 |
| 6,425,573 | B1 | * | 7/2002 | Suzuki | 261/35 |
| 6,446,939 | B1 | * | 9/2002 | Hoppe et al. | 261/35 |
| 6,481,403 | B1 | * | 11/2002 | Ashcraft et al. | 123/179.11 |
| 6,523,809 | B2 | * | 2/2003 | Woody | 261/35 |
| 6,595,500 | B2 | * | 7/2003 | Osburg et al. | 261/34.2 |
| 6,676,114 | B2 | * | 1/2004 | Gerhardy | 261/34.2 |

FOREIGN PATENT DOCUMENTS

| | | | |
|---|---|---|---|
| EP | 0786591 | 7/1997 | |
| JP | 4-339161 | * 11/1992 | 261/DIG. 68 |

* cited by examiner

*Primary Examiner*—Richard L. Chiesa
(74) *Attorney, Agent, or Firm*—Robert W Becker & Associates; Robert W Becker

(57) ABSTRACT

A carburetor arrangement for an internal combustion engine in a manually guided implement, such as a power chainsaw, a cut-off machine, etc. is provided. A regulating chamber delimited by a regulating diaphragm is provided. Upon deflection of the diaphragm due to underpressure in the regulating chamber, the latter is connected with a fuel tank. Via at least one nozzle, the regulating chamber opens into an air channel that supplies fuel/air mixture to the engine. The carburetor arrangement includes a scavenging pump that is disposed in a return line from the regulating chamber to the fuel tank, and in which is formed a pump chamber. The scavenging pump serves to completely fill the regulating chamber with fuel before start-up of the engine. To prevent the fuel/air mixture from becoming too lean after start-up, especially upon opening of the choke valve, a supply line is provided from the pump chamber into the air channel and supplies additional fuel to the air channel during the run-up phase.

22 Claims, 4 Drawing Sheets

CARBURETOR ARRANGEMENT

BACKGROUND OF THE INVENTION

The present invention relates to a carburetor arrangement for an internal combustion engine in a manually guided implement, such as a power chainsaw, a cut-off machine, or the like.

EP 0 786 591 discloses a carburetor arrangement that includes a scavenging pump and an injection pump as the actual starting aid. By actuating the injection pump, fuel can be introduced into the intake channel prior to starting the engine. As a result, an adequate supply of fuel to the internal combustion engine is intended to be achieved already for the first ignitions without a choke. The injected quantity of fuel is, however, consumed as the engine starts.

An internal combustion engine is generally started with the choke valve closed. If, after start-up of the engine, the choke valve is opened too rapidly, the mixture can become too lean, especially with a cold engine. As a consequence, the engine stalls. A renewed starting with the choke closed can lead to the supply of too much fuel to the combustion chamber. Numerous further attempts are then necessary in order to start the engine.

It is therefore an object of the present invention to provide a carburetor arrangement of the aforementioned general type that provides an adequate amount of fuel to an internal combustion engine during the starting and run-up phases.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
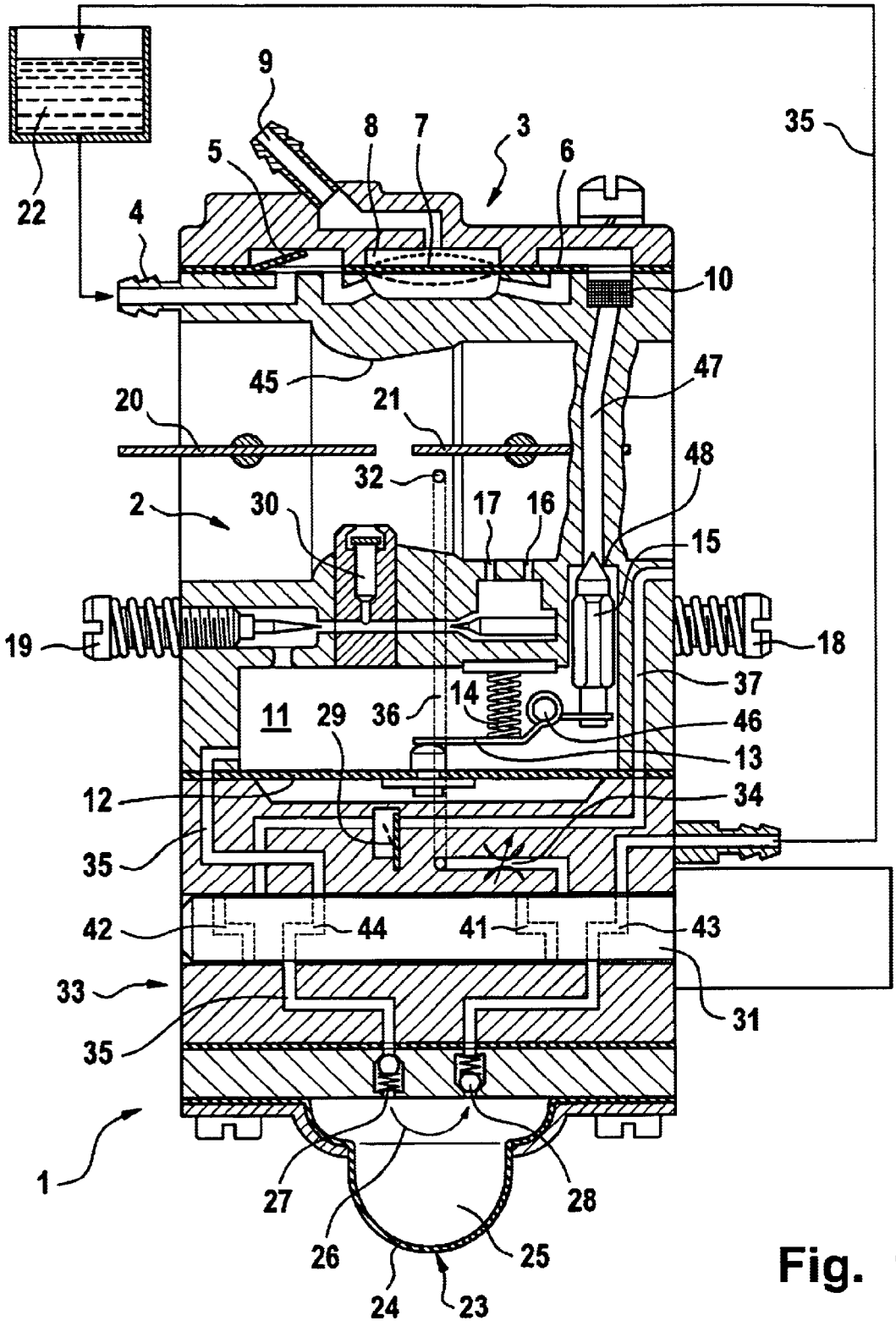
FIG. 1 is a cross-sectional view through one exemplary embodiment of an inventive diaphragm carburetor, with the third and fourth valves open.

The carburetor arrangement of the present invention comprises: a regulating chamber that is delimited by a regulating diaphragm and that, upon deflection of the diaphragm, is connected with a fuel tank, wherein the regulating chamber, via at least one nozzle, opens into an air channel that conveys fuel/air mixture to the internal combustion engine; a scavenging pump that is disposed in a return line that leads from the regulating chamber to the fuel tank, wherein a pump chamber is formed in the scavenging pump; and an intake mechanism that is provided with a supply line that is adapted to establish communication from the pump chamber into the air channel.

Due to the presence of the supply line from the pump chamber of the scavenging pump into the air channel, additional fuel can be supplied to the air channel. Due to the enrichment of the mixture from the pump chamber in the start-up and run-up phases of the engine, in the operating state the carburetor can be set to a lesser supply of fuel. In the full throttle range, the fuel consumption is thus reduced, whereupon the emissions are also reduced. The additional supply of fuel in the run-up phase causes the engine to already have a high output in this phase. Thus, the full output is not available only after run-up of the engine. The fuel is taken from the pump chamber of the scavenging pump. The pump chamber is thus nearly entirely emptied, so that the operator is forced to actuate the scavenging pump prior to the next start-up. This ensures that the regulating chamber is again completely filled with fuel. A filled pump chamber, which leads to the operator not actuating the scavenging pump, accompanied by simultaneous emptying of the regulating chamber, is thereby avoided.

It is provided that a first valve is disposed in the supply line that in particular in the run-up phase of the internal combustion engine is open. Thus, fuel can be supplied to the engine in this phase of operation in a precisely controlled manner. In particular, a second valve is disposed in a pressure line that opens into the pump chamber. The pressure line expediently connects the crankcase of the internal combustion engine with the pump chamber. By means of the pressure conveyed via the pressure line into the pump chamber, the discharge of fuel into the air channel is ensured. The valve permits the precise switching on and off of the pressure charge. To avoid a fuel supply from the pump chamber, via the pressure line, into the crankcase of the internal combustion engine, a check valve, especially a diaphragm check valve, is disposed in the pressure line. The first and second valves are expediently coupled in such a way that both valves are either opened or closed. By charging the scavenging pump with pressure via the pressure line, there is ensured that fuel can flow out of the pump chamber to the air channel.

A third valve is expediently disposed in the return line downstream of the pump chamber. In particular, a fourth valve is disposed in the return line upstream of the pump chamber. The third and fourth valves are in particular coupled in such a way that both valves are either opened or closed. When the third and fourth valves are opened, the scavenging pump can be used to purge the regulating chamber. In particular, the first valve is coupled with the third valve in such a way that one of the two valves is opened and the other is closed. When the third valve is opened, the scavenging pump is in pump operation. Upon actuation of the scavenging pump, fuel is drawn out of the fuel tank into the regulating chamber. Air that has accumulated in the regulating chamber is withdrawn from the regulating chamber with the fuel. Fuel and possibly air pass out of the regulating chamber into the pump chamber. When the pump chamber is nearly filled with fuel, the latter is conveyed into the fuel tank upon further actuation of the scavenging pump. In this phase, the first valve is closed, so that no fuel can pass out of the pump chamber into the air channel. With the first valve opened and the third valve closed, a flow of fuel out of the pump chamber into the fuel tank is prevented. The entire amount of fuel present in the pump chamber flows into the air channel. The second valve is expediently also coupled with the fourth valve in such a way that one of the valves is opened and the other is closed.

It is provided that a throttle valve is disposed in the supply line. As a result, it is possible to regulate the amount of fuel additionally introduced into the air channel via the supply line. In particular, a check valve is disposed in the supply line, with the opening pressure of the check valve being greater than the pressure that during idling of the internal combustion engine prevails in the pressure line. The check valve can, for example, have an opening pressure of 100 to 600 mbar, especially 200 to 400 mbar. Due to the check valve, a supply of fuel via the supply line is prevented during idling of the internal combustion engine.

The first, second, third and fourth valves are advantageously formed in a common valve slide. In this way, the valves are reliably coupled with one another. An appropriate valve slide or rotary valve can be produced in a straightforward manner. It is robust and can be easily operated. The diaphragm carburetor is provided with a pivotably mounted butterfly valve in the air channel, and upstream of the butterfly valve has a pivotably mounted choke valve. The position of at least one valve is advantageously coupled with the position of the choke valve. In particular, with choke valve open, the first valve is opened and the third valve is closed. During start-up of the engine, the regulating chamber can thus first be flooded with fuel. The choke valve is already closed for the start-up of the engine. The engine is then started. During opening of the choke valve, the first valve is opened, so that additional fuel is conveyed to the air channel in the run-up phase.

To prevent actuation of the scavenging pump in the run-up phase and in the operating phase, a cover element is provided, the position of which is coupled to the position of the third valve, and which cover element releases the scavenging pump when the third valve is opened. This ensures that the scavenging pump can only be used to draw fuel into the regulating chamber, and a pumping of fuel into the air channel via the first valve and the supply line is prevented.

Further specific features of the present invention will be described in detail subsequently.

DESCRIPTION OF PREFERRED EMBODIMENTS

Referring now to the drawings in detail, illustrated in FIG. 1 is a carburetor arrangement that comprises a diaphragm carburetor 1 into which is integrated a scavenging pump module 33. The scavenging pump module 33 can, however, also be embodied separately. Formed in the diaphragm carburetor 1 is an air channel 2 in which are disposed a rotatably or slidably mounted choke valve 20 and, downstream of the choke valve, a butterfly valve 21. The air channel 2 is provided in particular in the region between the choke valve 20 and the butterfly valve 21 with a venturi section 45. A primary idling nozzle opens out in the region of the butterfly valve 21, and upstream of the primary idling nozzle 16 a secondary idling nozzle 17 opens out into the air channel 2. With the butterfly valve 21 closed, the primary idling nozzle 16 is disposed downstream of the butterfly valve 21 and the secondary idling nozzle 17 is disposed upstream of the butterfly valve 21.

A main nozzle 30 opens out into the air channel 2 in the region of the venturi section 45. The fuel supply of the idling nozzles 16, 17 can be adjusted via an idling set screw 18. The fuel supply of the main nozzle 30 is adjustable via a main set screw 19. The nozzles 16, 17, 30 are supplied from a regulating chamber 11, which is in turn supplied with fuel from the fuel tank 22. A regulating diaphragm 12 is disposed in a wall that delimits the regulating chamber 11. That side of the regulating diaphragm 12 that faces away from the regulating chamber 11 is acted upon by pressure, for example by the pressure that prevails downstream of the air filter, or by ambient pressure. If there is an underpressure in the regulating chamber 11, the regulating diaphragm 12 is deflected in a direction toward the regulating chamber 11. The inlet control lever 13, which is mounted on a pin 46 and is supported against one wall of the regulating chamber 11 via the inlet spring 14, actuates the inlet needle 15, which thereby releases the opening 48. The regulating chamber 11 is thus supplied with fuel via the fuel line 47.

A fuel filter 10 is disposed in the fuel line 47. Disposed upstream of the fuel filter 10 is the diaphragm pump 3, which serves for conveying the fuel. The fuel line 47 is connected with the fuel tank 22 via the fuel intake connector 4. The diaphragm pump 3 is provided with a pump diaphragm 7, one side of which delimits the fuel line 47, and the other side of which is in contact with a pulse chamber 8 that communicates with a pulsating pressure via a pulse fitting 9. As a consequence of the pulsating pressure, the pump diaphragm 7 is deflected, especially toward both sides. Disposed upstream of the pump diaphragm 7 is an inlet valve 5, and disposed downstream of the pump diaphragm is an outlet valve 6. The inlet valve 5 and the outlet valve 6 are embodied as check valves and prevent a return flow of the fuel. When the inlet valve 5 is opened, fuel flows into the diaphragm pump 3. As the pressure in the diaphragm pump 3 increases, the outlet valve 6 opens, while the inlet valve 5 closes. The fuel flows out of the diaphragm pump 3.

The scavenging pump module 33 includes a scavenging pump 23 having a pump bellows 24, which is in particular made of an elastic polymeric material. The scavenging pump 23 also has a pump chamber 25 that is formed in the pump bellows 24. In this connection, the pump chamber 25 designates the chamber into which fuel is drawn during operation of the pump, and out of which the fuel is pressed. From the regulating chamber 11, a return line 35 leads through the scavenging pump 23 to the fuel tank 22. Disposed upstream of the scavenging pump 23, in the return line 35, is a check valve 27, and disposed downstream of the scavenging pump 23 is a check valve 28. The check valves 27, 28 are in particular disposed directly at the inlet and the outlet into and out of the pump chamber 25 respectively. The check valves ensure that the scavenging pump 23 can convey fuel only in the conveying direction 26. A flowing of the fuel in the opposite direction is prevented by the check valves 27, 28. Formed in the return line 35, between the regulating chamber 11 and the scavenging pump 23, is a fourth valve 44. Downstream of the scavenging pump 23 the return line 35 is provided with a third valve 43. The valves 43 and 44 are formed in a common valve slide 31. Thus, the third valve 43 and the fourth valve 44 are opened and closed in common. Also disposed in the valve slide 31 are a first valve 41 and a second valve 42, which are both closed in the position of the valve slide 31 shown in FIG. 1.

In the position of the valve slide 31 shown in FIG. 1, by pressing the pump bellows 24 in, the fuel present in the pump chamber 25 is partially pressed out of the pump chamber through the check valve 28. When the shape of the pump bellows 24 returns due to its elasticity, an underpressure is produced in the pump chamber 25 that effects a flowing of fuel from the regulating chamber 11 into the pump chamber 25. In this way, fuel is drawn in from the fuel tank 22 via the regulating chamber 11. The underpressure in the pump chamber 25 produces in the regulating chamber 11 an underpressure that effects the opening of the opening 48. As a result, fuel is drawn into the regulating chamber 11 from the fuel tank 22. From the regulating chamber 11, fuel and air that has accumulated in the regulating chamber 11 are drawn into the pump chamber 25. When the pump chamber 25 is nearly full of fuel, upon further actuation of the scavenging pump the fuel is pressed via the return line 35 into the fuel tank 22. This ensures that even after the internal combustion engine has not been running, the regulating chamber 11 can be completely filled with fuel prior to starting the engine.

Figure 2:
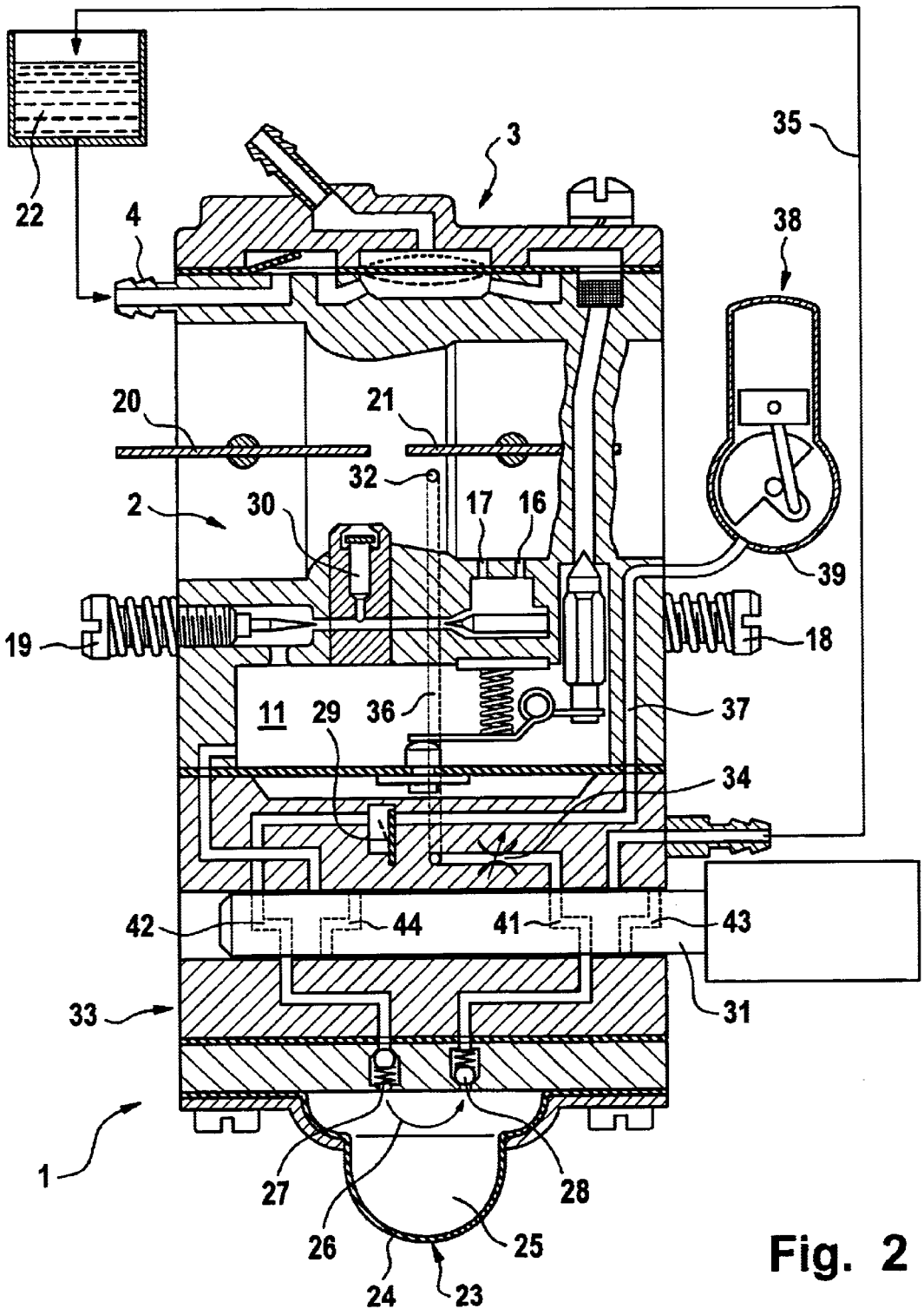
FIG. 2 shows the carburetor of FIG. 1 with the first and second valves open.

In FIG. 2, the diaphragm carburetor 1 is shown with the valve slide 31 in a position in which the first valve 41 and the second valve 42 are opened, and the third valve 43 and the fourth valve 44 are closed. The second valve 42 is disposed in a pressure line 37 that connects the pump chamber 25 with the crankcase 39 of an internal combustion engine 38. The section of line between the second valve 42 and the scavenging pump 23 is thereby at the same time a portion of the return line 35 when the second valve 42 is closed and the fourth valve 44 is opened. The check valve 27 thus also acts in the pressure line 37. Disposed in the pressure line 37 is a diaphragm check valve 29 that rectifies the pulse from the crankcase, which has an approximately sinusoidal shape. Thus, only the high pressure sides of the pulse can reach the pump chamber 25. As a result, there is largely prevented a drawing-in of fuel from the pump chamber 25 and the pressure line 37 into the crankcase 39.

Downstream of the pump chamber 25, a supply line 36 leads from the pump chamber into the air channel 2. The supply line 36 opens into the air channel 2 via a bore 32. Disposed in the supply line 36 is the first valve 41, which is formed in the valve slide 31 and is thus coupled with the second, third and fourth valves. The portion of the line formed between the first valve 41 and the pump chamber 25 is a portion of the return line 35 when the third valve 43 is opened and the first valve 41 is closed. Disposed downstream of the first valve 41, in the supply line 36, is a throttle valve 34 that serves to regulate the quantity of fuel that is to be injected.

Prior to starting the engine, and during the first combustions, in particular as long as the choke valve 20 is closed, the valve slide 31 is expediently in the position illustrated in FIG. 1, where the third valve 43 and the fourth valve 44 are open. After the engine has started, especially during the run-up phase after the first combustions, i.e. with the choke valve 20 open, the valve slide 31 is expediently in the position illustrated in FIG. 2, where the first valve 41 and the second valve 42 are open, and the third valve 43 and the fourth valve 44 are closed.

In the position of the valve slide 31 illustrated in FIG. 2, the fuel is conveyed out of the pump chamber 25 into the air channel 2 via the supply line 36 as a consequence of the pressure that is produced in the crankcase 39 and that is conveyed via the pressure line 37 into the pump chamber 25. As a result, the fuel/air mixture in the air channel is enriched with additional fuel. This prevents the fuel/air mixture from becoming lean. At the same time, the pump chamber 25 is thereby in particular completely emptied. The quantity of fuel present in the pump chamber 25 is expediently such that after injection of the fuel quantity into the air channel 2, the internal combustion engine 38 has run up, and an enrichment of the fuel/air mixture is no longer necessary.

Figure 3:
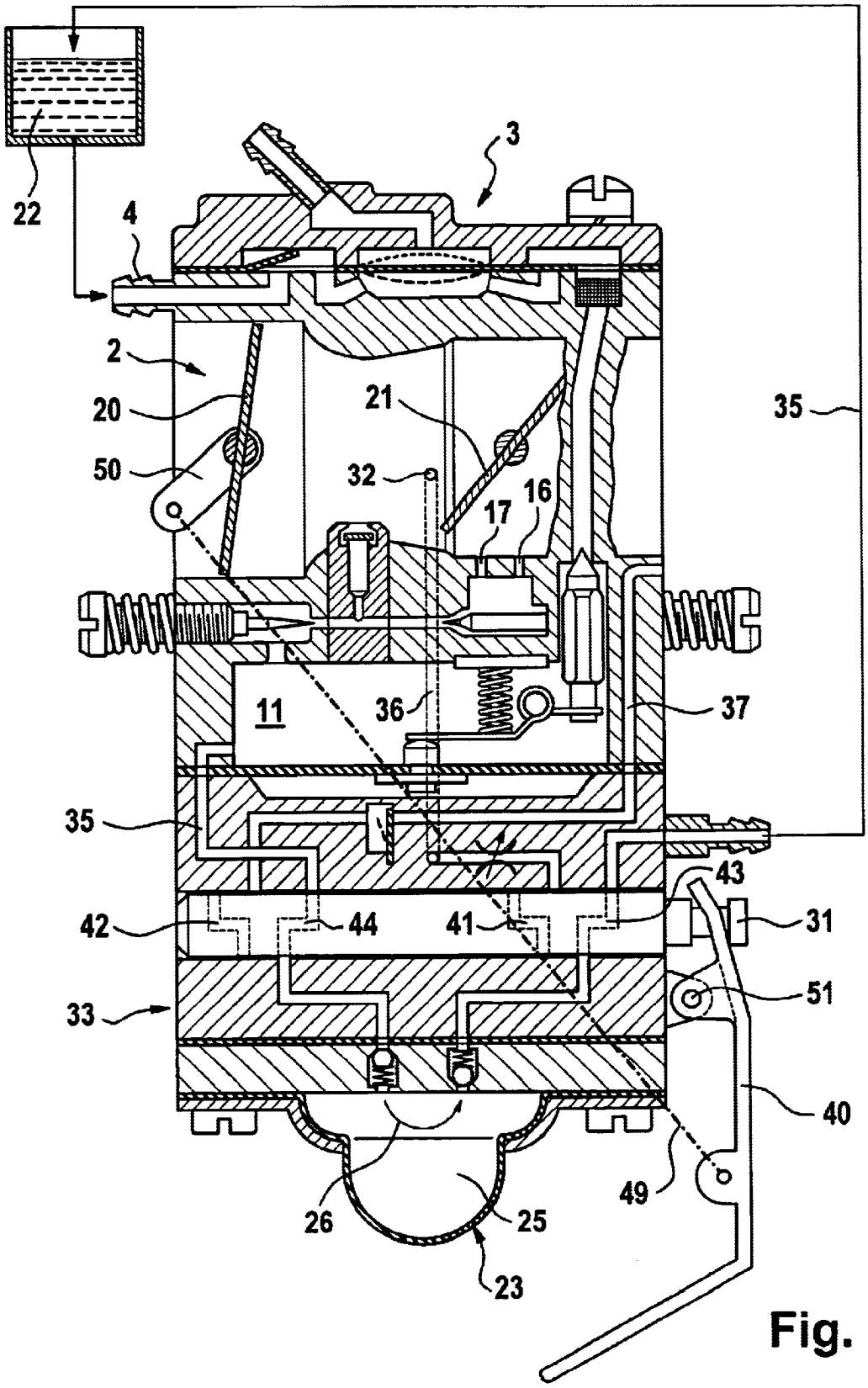
FIG. 3 shows the carburetor arrangement in the start-up phase with the choke valve coupled to the valve position.
Figure 4:
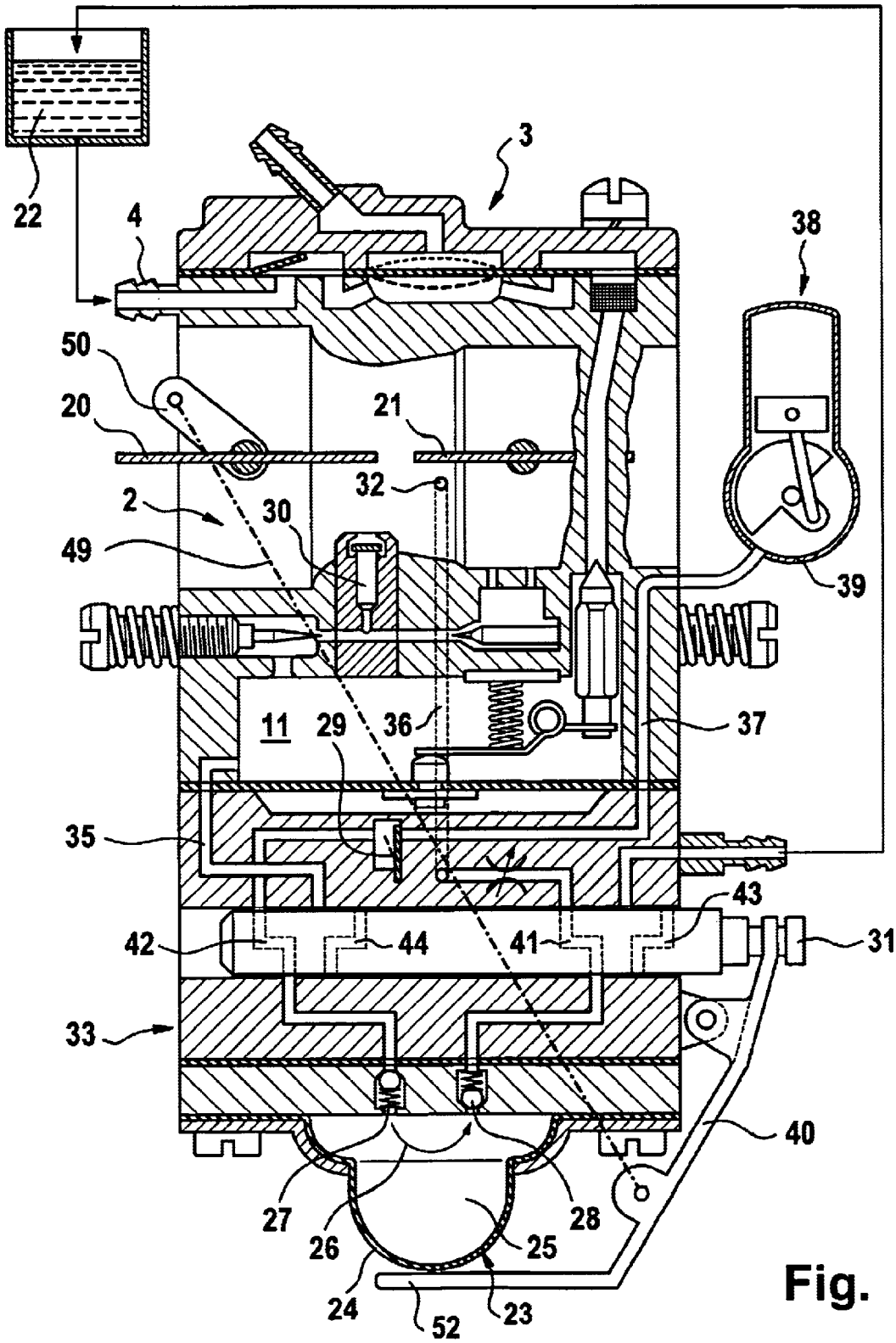
FIG. 4 shows the carburetor arrangement of FIG. 3 in the run-up phase.

To couple the position of the valves 41, 42, 43, 44 to the position of the choke valve 20, a coupling mechanism 49, such as that illustrated in FIGS. 3 and 4, can be provided. The control lever 40 of the choke valve 20 is coupled via the coupling mechanism 49, which can, for example, be embodied as a lever, to a lever 50 that is fixedly connected with the choke valve 20. Actuation of the control lever 40 thus effects, via the coupling mechanism 49 and the lever 50, an opening or closing of the choke valve 20. The control lever 40 at the same time actuates the slide valve 31, in which the valves 41, 42, 43, 44 are formed.

In FIG. 3, the system is illustrated in the starting position. The choke valve 20 is closed. The butterfly valve 21 is slightly opened. By means of the lever 50 and the coupling mechanism 49, the control lever 40 is coupled with the position of the choke valve 20. The control lever 40, which is embodied as a tilt lever, simultaneously actuates the valve slide 31. The pivot point 51 of the control lever 40 is fixed in position on the scavenging pump module 33. When the choke valve 20 is closed, the third valve 43 and the fourth valve 44 in the valve slide 31 are open, as illustrated in FIG. 3. By actuating the scavenging pump 23, fuel can thus be drawn out of the fuel tank 22 and into the regulating chamber 11. After the regulating chamber 11 is completely filled with fuel, the engine is started. Due to the closed choke valve 20, air can flow in the direction of the internal combustion engine only through a bypass formed in the choke valve 20. By means of the idling nozzles 16 and 17, fuel is supplied to the combustion air. The fuel/air mixture, which has a relatively high proportion of fuel, is supplied to the internal combustion engine 38.

After the first few combustions, the choke valve 20 is opened by the operator. This can be effected, for example, by actuating the control lever 40. The opened choke valve 20 is illustrated in FIG. 4. The control lever 40 has a portion 52 that in the position of the control lever 40 illustrated in FIG. 4 covers the pump bellows 24 of the scavenging pump 23. The pump bellows 24 is not accessible for the operator, so that an actuation of the scavenging pump 23 is prevented. The control lever 40 simultaneously actuates the valve side 31, as a result of which the third valve 43 and the fourth valve 44 are closed, and the first valve 41 and the second valve 42 are opened. The pump chamber 25 is connected via the pressure line 37 with the crankcase 39 of the internal combustion engine 38. The overpressure that is rectified by the diaphragm check valve 29 presses the fuel out of the pump chamber 25 into the supply line 36. By means of the bore 32, the fuel is supplied to the air channel 2. As a result of the opened choke valve 20, a large portion of combustion air can flow through the air channel 2 in the direction of the internal combustion engine 38. An adequate fuel supply is ensured in the run-up phase by the fuel from the pump chamber 25 that is additionally supplied to the air channel 2. As soon as the pump chamber 25 is emptied, no additional fuel can any longer be supplied to the air channel 2. Since to this point in time the engine has warmed up, additional supply of fuel is no longer necessary.

Instead of the valves formed in the valve slide, individual valves can also be provided that can be coupled in any desired manner. The opening pressure of the check valve 27 or 28 can expediently have an opening pressure of 100 to 600 mbar, especially 200 to 400 mbar. At a pressure in the pressure line 37 during idling of the internal combustion engine 38 of about 50 mbar, an opening pressure of the check valve 28 of about 250 mbar is advantageous. Instead of the portion 52 of the control lever 40 that covers the pump bellows 24 of the scavenging pump 23, and thus forms a cover element, and which is monolithically formed with the control lever 40, it can be advantageous to provide for this purpose a separate cover element, the position of which is coupled to the position of the valves, i.e. of the valve slide. To make the scavenging pump 23 inaccessible, the cover element expediently covers the scavenging pump 23 at least partially; however, it can also be advantageous for the cover element to make the scavenging pump 23 inaccessible or to expose it in some other manner.

The specification incorporates by reference the disclosure of German priority document 102 33 282.7 filed 23 Jul. 2002.

The present invention is, of course, in no way restricted to the specific disclosure of the specification and drawings, but also encompasses any modifications within the scope of the appended claims.

What is claimed is:

1. A carburetor arrangement for an internal combustion engine in a manually guided implement, comprising:

a regulating chamber that is delimited by a regulating diaphragm and that, upon deflection of said regulating diaphragm, is connected with a fuel tank, wherein said regulating chamber via at least one nozzle opens into an air channel that conveys fuel/air mixture to the internal combustion engine;

a scavenging pump disposed in a return line that leads from said regulating chamber to said fuel tank wherein a pump chamber is formed in said scavenging pump; and an intake mechanism that is provided with a supply line that is adapted to establish communication from said pump chamber into said air channel.

2. A carburetor arrangement according to claim 1, wherein a first valve is disposed in said supply line.

3. A carburetor arrangement according to claim 2, wherein in a run-up phase of said internal combustion engine, said first valve is open.

4. A carburetor arrangement according to claim 2, wherein a second valve is disposed in a pressure line that opens into said pump chamber.

5. A carburetor arrangement according to claim 4, wherein said pressure line connects a crankcase of said internal combustion engine with said pump chamber.

6. A carburetor arrangement according to claim 4, wherein a check valve is disposed in said pressure line.

7. A carburetor arrangement according to claim 4, wherein said first valve and said second valve are coupled in such a way that both valves are either opened or closed.

8. A carburetor arrangement according to claim 4, wherein a third valve is disposed in said return line downstream of said pump chamber.

9. A carburetor arrangement according to claim 8, wherein a fourth valve is disposed in said return line upstream of said pump chamber.

10. A carburetor arrangement according to claim 9, wherein said third valve and said fourth valve are coupled in such a way that both valves are either opened or closed.

11. A carburetor arrangement according to claim 9, wherein said first valve is coupled with said third valve in such a way that one of said first and third valves is opened and the other of said third and first valves is closed.

12. A carburetor arrangement according to claim 9, wherein said second valve is coupled with said fourth valve in such a way that one of said second and fourth valves is opened and the other of said fourth and second valves is closed.

13. A carburetor arrangement according to claim 1, wherein a throttle valve is disposed in said supply line.

14. A carburetor arrangement according to claim 1, wherein a check valve is disposed in said supply line, and wherein said check valve has an opening pressure that is greater than a pressure that during idling of the internal combustion engine prevails in a pressure line that opens into said pump chamber.

15. A carburetor arrangement according to claim 14, wherein said check valve has an opening pressure of 100 to 600 mbar.

16. A carburetor arrangement according to claim 9, wherein said first valve, said second valve, said third valve and said fourth valve are formed in a common valve slide.

17. A carburetor arrangement according to claim 16, wherein disposed in said air channel are a pivotably mounted butterfly valve, and upstream of said butterfly valve a pivotably mounted choke valve.

18. A carburetor arrangement according to claim 17, wherein a position of at least one of said first, second, third and fourth valves—is coupled with a position of said choke valve.

19. A carburetor arrangement according to claim 18, wherein a control lever is provided, and wherein a position of said control lever couples said choke valve with a position of said valve slide.

20. A carburetor arrangement according to claim 18, wherein when said choke valve is open, said first valve is open.

21. A carburetor arrangement according to claim 18, wherein when said choke valve is closed, said third valve is open.

22. A carburetor arrangement according to claim 8, wherein a cover element is provided, wherein a position of said cover element is coupled to a position of said third valve, and wherein said cover element releases said scavenging pump when said third valve is open.

* * * * *